United States Patent [19]

Lips

[11] Patent Number: 5,033,387

[45] Date of Patent: Jul. 23, 1991

[54] EXPLOSIVE CHARGE FACING

[75] Inventor: Hendrik R. Lips, Düsseldorf, Fed. Rep. of Germany

[73] Assignee: Rheinmetall GmbH, Düsseldorf, Fed. Rep. of Germany

[21] Appl. No.: 447,401

[22] Filed: Nov. 5, 1982

[30] Foreign Application Priority Data

Nov. 7, 1981 [DE] Fed. Rep. of Germany ..... 3144354

[51] Int. Cl.[5] ..... F42B 1/032; F42B 12/16

[52] U.S. Cl. ..... 102/475; 102/305; 102/306; 102/476

[58] Field of Search ..... 102/475, 476, 473, 305, 102/306, 307, 309

[56] References Cited

U.S. PATENT DOCUMENTS

| | | | |
|---|---|---|---|
| 2,974,595 | 3/1961 | Mohaupt | 102/476 X |
| 3,025,794 | 3/1962 | Lebourg et al. | 102/306 |
| 3,235,005 | 2/1966 | Delacour | 102/306 X |
| 3,237,559 | 3/1966 | Auberlinder | 102/306 |
| 3,437,036 | 4/1969 | Franzen et al. | 102/306 X |
| 3,732,816 | 5/1973 | Müller | 102/306 |
| 3,802,342 | 4/1974 | Berlot et al. | 102/309 |
| 4,041,866 | 8/1977 | Thevenin et al. | 102/306 |
| 4,050,381 | 9/1977 | Heinemann | 102/476 X |
| 4,080,898 | 3/1978 | Gieske | 102/306 |
| 4,122,775 | 10/1978 | Held | 102/306 X |

FOREIGN PATENT DOCUMENTS

| | | | |
|---|---|---|---|
| 2336750 | 4/1975 | Fed. Rep. of Germany | 102/476 |
| 2425047 | 11/1979 | France . | |

*Primary Examiner*—David H. Brown

*Attorney, Agent, or Firm*—Spencer & Frank

[57] ABSTRACT

An explosive charge provided with a metal facing for the formation of an essentially rod-shaped projectile by detonative conversion of the facing. The facing is provided in its central region with a coating of a material which is denser than the material of the facing.

20 Claims, 1 Drawing Sheet

EXPLOSIVE CHARGE FACING

BACKGROUND OF THE INVENTION

The present invention relates to an explosive charge which is provided with a metal facing or liner for the formation of an essentially rod-shaped projectile by detonative conversion.

In connection with projectile forming explosive charge facings, a distinction must be made between those in which a projectile is formed from the facing during a detonative conversion or explosive forming process, and those in which the projectiles are already in existence in the facing, for example as rods which are arranged in a meander shape and whose ends are welded together. A significant feature of explosive charges provided with such facings is that the target effectiveness of the resulting projectile is assured over a much greater distance between target and point of detonation than corresponds to the customary effective range of a pointed cone hollow or shaped charge. While the rods provided in the facing move toward the target in a direction transverse to their respective longitudinal axis, the longitudinal axis of a projectile formed by detonative conversion lies essentially in its direction of movement. In the latter case, it is desired to realize a ratio of projectile length 1 to projectile diameter d which is advantageous for flight and effective at the target.

With respect to the above-mentioned large distances, the stabilization of the flight path of such a projectile is of special significance since its target effectiveness, which is directed specifically toward penetration, depends essentially on the best possible utilization of the 1/d ratio, which is preferably large, at the moment of impact. Consequently, the projectiles likewise have a rod shape. X-ray flash photographs during tests indicate that such a projectile having a desirable 1/d ratio yaws on its path of flight, and consequently there exists the danger that the longitudinal axis of the projectile encloses an undesirably large angle with the path of flight at the moment when the projectile hits the target.

SUMMARY OF THE INVENTION

It is the object of the present invention to provide a facing of the above-mentioned type from which, during detonative conversion, a rod-shaped, aerodynamically stable projectile is formed.

The above object is achieved according to the present invention in that in an explosive charge provided with a metal facing or liner for the formation of an essentially rod-shaped projectile by detonative conversion of the facing, the facing is provided in its central region with a coating of a material which is denser than that of the facing material.

According to various embodiments of the invention, the coating may be located on the inner or outer surface of the facing. Moreover, according to further features of the invention, an additional ring-shaped coating of a material less dense than the material of the facing may be provided on the outer or inner surface of the facing.

DETAILED DESCRIPTION OF THE PREFERRED EMBODIMENTS

Figures 1A, 1B, 1C, 2A, 2B, 2C, 3A, 3B, 3C:
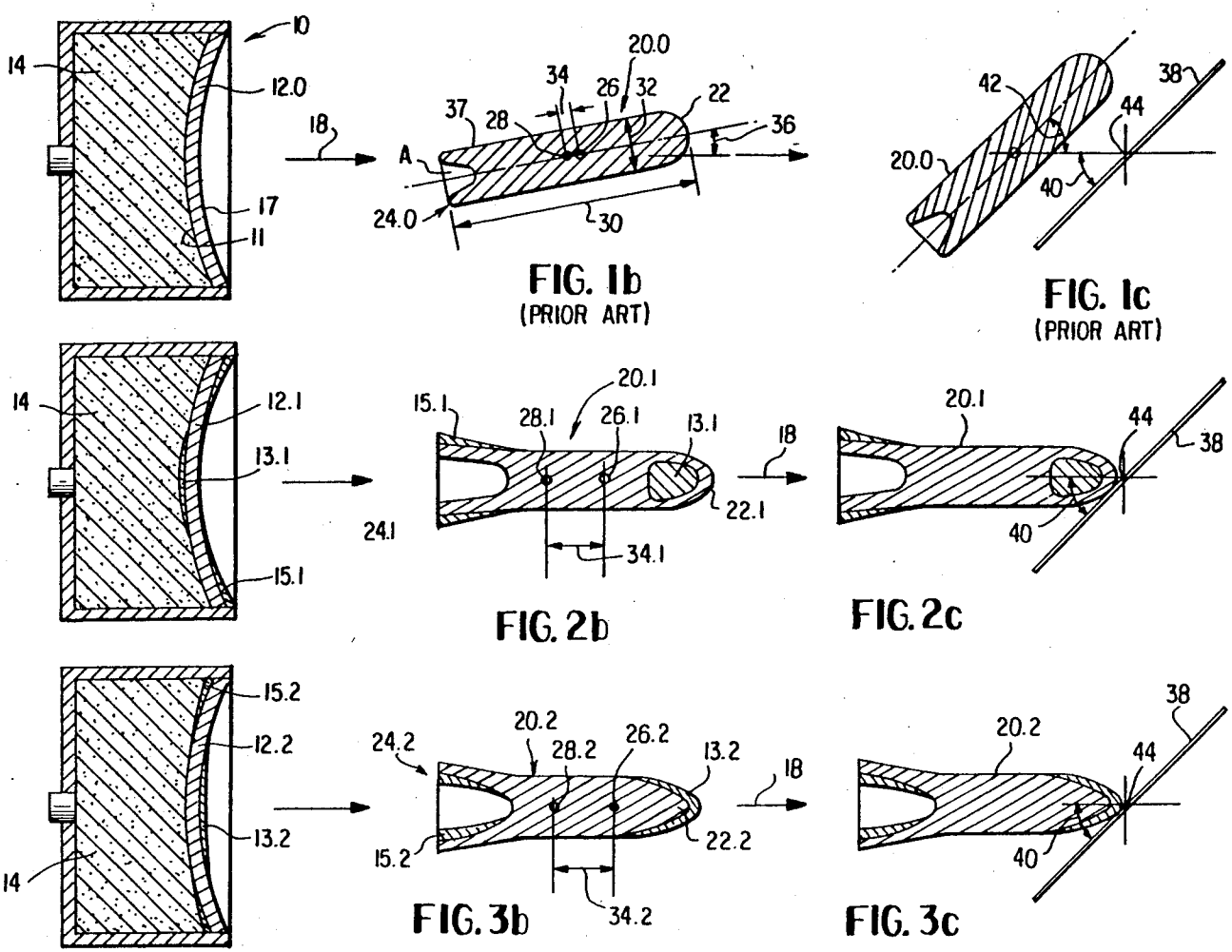
FIG. 1a (PRIOR ART)
FIG. 1b (PRIOR ART)
FIG. 1c (PRIOR ART)
FIGS. 1*a*, 1*b* and 1*c* are schematic sectional views, next to one another along the effective axis or the flight path of, respectively, an explosive charge with facing in the initial state according to the prior art, a projectile formed of the facing of FIG. 1*a* on its flight path, and finally the projectile as it hits a target.
FIGS. 2*a*–2*c* and 3*a*–3*c* are schematic sectional views similar to those of FIGS. 1*a*–1*c*, respectively, but showing first and second embodiments according to the invention.

Turning now to FIGS. 1*a*–1*c*, there is shown (FIG. 1*a*) an explosive charge 10 in which the explosive 14 is provided with a recess at its frontal surface, not identified in detail, which is covered with a rotationally symmetrical spherically-shaped facing 12.0, for example of copper, iron or another suitable material, whose rear or inner surface 11 faces the explosive 14 and whose front or outer surface 17 faces the target 38 (FIG. 1*c*). During the detonative conversion of the facing 12.0 in a known manner, a rod-shaped projectile 20.0 (FIG. 1*b*) is formed from the facing 12.0 and moves on a flight path 18 toward the target 38.

As shown in FIG. 1*b*, the projectile 20.0 includes: a frontal member 22, a rear member 24.0 and a circumferential surface 37, and has a length (l) 30 and a diameter (d) 32. The longitudinal axis A of the projectile 20.0 forms a yaw angle as indicated by 36 (FIG. 1*b*) with the flight path 18. The center of gravity 26 of the projectile 20.0, which is essentially at the front, is separated by only a small distance 34 from an essentially rearward air attack point 28. This relationship explains the projectile's tendency to yaw and an increase in the yaw angle from the value indicated by 36 to the value indicated by 42 (FIG. 1*c*) is frequently noted. A yaw angle as indicated by 42 produces the drawback that with an angle between the flight path 18 and the track of the target plate 38 in the plane of the drawing as indicated by the reference numeral 40, the circumferential surface 37 of the projectile 20.0 hits the target plate 38 in the region of a point of impact 44 (end of the theoretical flight path on target plate 38). An original favorable length to diameter ratio of, for example $l/d=5$, of the projectile 20.0 may here be reduced, in the most unfavorable case, to the entirely insufficient value of 0.2. In this way, the target effectiveness, which is directed toward penetration, is impaired to an extraordinary degree.

According to the first embodiment of the invention as shown in FIG. 2*a*, the facing 12.1 of the explosive charge is covered, in the central region of its rear or inner side 11, with a coating 13.1 of a material whose density is greater than that of the material of the facing 12.1. Moreover, the front or outer surface 17 of the facing 12.1 is provided with a coating 15.1 which has a circular ring shape and is made of a material having a lesser density than the material of the facing 12.1. In this way, the facing 12.1 forms a substrate for the coatings 13.1 and 15.1.

As shown in FIG. 2*b*, due to the reshaping of the facing 12.1 by detonative conversion in the known manner, the material of the coating 13.1 will be enclosed by the material of the facing 12.1 and be located in the front portion 22.1 of the projectile 20.1, while the material of the coating 15.1, which was originally arranged on the peripheral region of the facing 12.1, is disposed on the exterior surface of the rear portion 24.1 of the projectile 20.1. Due to the above-mentioned differences in density and the distribution of the three involved materials to different regions of projectile 20.1, there results a greater axial distance 34.1 between the now more forwardly located center of gravity 26.1 of the projectile and the now more rearwardly located air attack point 28.1 as compared to those of projectile 20.0 of FIG. 1*b*.

The result of the distribution of three different materials of different density is an aerodynamically stable behavior of the projectile 20.1 on its flight path 18 and impact on the target 38 with substantial utilization of the original l/d ratio which is directed toward penetration as shown in FIG. 2*c*. Advantageously the material of the coating 15.1 arranges itself in the circumferential region while increasing the rearward diameter of the projectile 20.1, so that the rear portion 24.1 involved becomes effective as a resistance guide mechanism.

According to the embodiment of the invention shown in FIG. 3*a*, a coating 13.2 of a comparatively denser material than that of the facing 12.2 is disposed in the central region of the front or outer surface 17 of a facing 12.2 and an again circular ring-shaped coating 15.2 of a material with a comparatively lesser density than the material of the facing 12.2 is disposed on the rear or inner surface 11 of the facing 12.2.

After the detonative conversion of the facing 12.2 into a projectile 20.2 as shown in FIG. 3*b*, the material of the coating 13.2 is again disposed in the region of the frontal portion 22.2, but this time as a covering on the tip of the projectile 20.2, and the material of coating 15.2 is disposed in the region of a rear portion 24.2, but this time as a widening, interior lining. This arrangement, as shown in FIG. 3*c*, likewise produces the favorable conditions described in connection with the embodiment of FIG. 2.

The material for the substrate or facings 20.1 and 20.2 may be, for example, iron, copper or nickel. Suitable materials for the coatings 13.1 and 13.2 are, for example, tungsten, molybdenum, tantallum and deriched uranium.

The coating 15.1, 15.2 may be made, for example, of aluminum, magnesium, titanium or zirconium. By using deriched uranium, titanium and zirconium, it is possible to realize, in an advantageous manner, an additional pyrophoric effect in addition to the already mentioned effects.

It will be understood that the above description of the present invention is susceptible to various modifications, changes and adaptations, and the same are intended to be comprehended within the meaning and range of equivalents of the appended claims.

What is claimed is:

1. In an explosive charge provided with a metal facing for the formation of an essentially rod-shaped projectile by detonative conversion; the improvement wherein said facing is provided only in its central region with a coating of a material which is denser than that of the facing material.

2. An explosive charge provided with a facing as defined in claim 1 wherein an additional coating in the form of a circular ring is provided on a surface of said facing adjacent its peripheral edge, said additional coating being formed of a material which has a lesser density than the material of said facing.

3. An explosive charge provided with a facing as defined in claim 1 wherein said charge is rotationally symmetrical and is provided with a spherical recess on its frontal surface, and said facing covers said frontal surface.

4. An explosive charge provided with a facing as defined in claim 1 wherein said coating is disposed on the outer surface of said facing.

5. An explosive charge provided with a facing as defined in claim 4 wherein an additional coating in the form of a circular ring is provided on a surface of said facing, said additional coating being formed of a material which has a lesser density than the material of said facing.

6. An explosive charge provided with a facing as defined in claim 5 wherein said additional coating is disposed on the inner surface of said facing.

7. An explosive charge provided with a facing as defined in claim 6 wherein said additional coating is disposed adjacent the peripheral edge of said facing.

8. An explosive charge provided with a facing as defined in claim 1 wherein said coating is disposed on the inner surface said facing.

9. An explosive charge provided with a facing as defined in claim 8 wherein an additional coating in the form of a circular ring is provided on a surface of said facing, said additional coating being formed of a material which has a lesser density than the material of said facing.

10. An explosive charge provided with a facing as defined in claim 9 wherein said additional coating is disposed on the outer surface of said facing.

11. An explosive charge provided with a facing as defined in claim 10 wherein said additional coating is disposed adjacent the peripheral edge of said facing.

12. In a self forging fragment warhead, including an explosive charge provided with a metal facing, for the generation of a fragment in the form of an essentially rod-shaped projectile from said facing, with the projectile having a central longitudinal axis on which the center of gravity lies in front of the point of air attack of the projectile, the improvement wherein a coating of a material whose density is different than that of said metal of said facing is provided on only a selected portion of a surface of said facing, with the density and location of said coating being selected so that the location of the coating material in the generated projectile will cause the distance between the center of gravity and the air attack point of the generated projectile to be increased ion order to aerodynamically stabilize the projectile on its trajectory.

13. A self forging warhead as defined in claim 12 wherein said material of said coating has a density greater than that of said metal of said facing and is disposed only in the central region of said facing.

14. A self forging warhead as defined in claim 13 wherein said coating is disposed on the inner surface of said facing.

15. A self forging warhead as defined in claim 13 wherein said coating is disposed on the outer surface of said facing.

16. A self forging warhead as defined in claim 15 wherein an additional coating in the form of a circular ring is provided on the inner surface of said facing adjacent its peripheral edge, with said additional coating being formed of a material which has a lesser density than said metal of said facing.

17. A self forging warhead as defined in claim 13 wherein an additional coating in the form of a circular ring is provided on a surface of said facing with said additional coating being formed of a material which has a lesser density than said metal of said facing.

18. A self forging warhead as defined in claim 17 wherein said coating and said additional coating are each formed of metal.

19. A self forging warhead as defined in claim 18 wherein an additional coating in the form of a circular ring is provided on the outer surface of said facing adjacent its peripheral edge, with said additional coating being formed of a material which has a lesser density than said metal of said facing.

20. A self forging warhead as defined in claim 19 wherein said coating and each additional coating are each formed of metal.

* * * * *